US008267343B2

(12) United States Patent
Döring et al.

(10) Patent No.: US 8,267,343 B2
(45) Date of Patent: Sep. 18, 2012

(54) WINDING MACHINE AND METHOD FOR CONTROLLING A WINDING MACHINE

(75) Inventors: Ernst Döring, Schimberg (DE); Helmut Rabe, Wehretal (DE); Bernd Wilhelm, Groβalmerode (DE); Matthias Hollstein, Meiβner (DE)

(73) Assignee: Georg Sahm GmbH & Co. KG, Eschwege (DE)

( * ) Notice: Subject to any disclaimer, the term of this patent is extended or adjusted under 35 U.S.C. 154(b) by 318 days.

(21) Appl. No.: 12/792,112

(22) Filed: Jun. 2, 2010

(65) Prior Publication Data

US 2010/0308151 A1 Dec. 9, 2010

(30) Foreign Application Priority Data

Jun. 9, 2009 (DE) ..... 10 2009 026 849

(51) Int. Cl.
*B65H 54/02* (2006.01)

(52) U.S. Cl. ..... 242/474.7

(58) Field of Classification Search ..... 242/474.3, 242/474.4, 474.7
See application file for complete search history.

(56) References Cited

U.S. PATENT DOCUMENTS

| | | | |
|---|---|---|---|
| 4,948,057 | A | 8/1990 | Greis |
| 5,522,560 | A | 6/1996 | Fleissner |
| 2008/0116311 | A1 | 5/2008 | Ludwig |

FOREIGN PATENT DOCUMENTS

| | | | |
|---|---|---|---|
| DE | 20 37 282 | | 10/1976 |
| DE | 26 43 271 | | 3/1978 |
| DE | 37 34 478 | C2 | 12/1991 |
| DE | 10 2005 003 334 | A1 | 8/2005 |
| DE | 102 23 484 | B4 | 4/2008 |
| DE | 10 2006 054 980 | B4 | 8/2008 |
| EP | 0 018 577 | B1 | 6/1982 |
| EP | 1 507 730 | B1 | 6/2010 |
| JP | 11 209001 | | 3/1999 |
| WO | 2008/020070 | A1 | 8/2007 |

OTHER PUBLICATIONS

European Search Report in co-pending, related EP Application No. 10 16 4841, mailed Jul. 19, 2011.

*Primary Examiner* — William E Dondero
(74) *Attorney, Agent, or Firm* — Thomas, Kayden, Horstemeyer & Risley, LLP

(57) ABSTRACT

The invention relates to a method for controlling a winding machine for winding a continuously fed winding material on bobbin tubes to wound packages. The winding machine comprises two driven spindles. A traversing device holds a traversing guide. The traversing guide is driven for a traversing movement, whereas the traversing device is driven for a changing movement in a changing direction transverse to the traversing movement. A control device controls both the traversing movement and the changing movement. The movement of said traversing device and said traversing guide is controlled for guiding the winding material from a package wound at a first spindle via a fixed transfer device to the second spindle. The winding material is caught by a catching device associated with the second spindle. The winding material is cut by a cutting device wherein the cutting movement is caused by a rotation of the second spindle.

20 Claims, 6 Drawing Sheets

WINDING MACHINE AND METHOD FOR CONTROLLING A WINDING MACHINE

CROSS REFERENCE TO RELATED APPLICATIONS

This application claims priority to co-pending German Patent Application No. DE 10 2009 026 849.9 entitled "Winding Machine with a Transfer Device and Method for Operating the same", filed Jun. 9, 2009.

FIELD OF THE INVENTION

The present invention generally relates to a winding machine for winding a continuously fed winding material, in particular a continuous thread, to packages or bobbins wound on bobbin tubes. The winding machine comprises two spindles with fixed spindle axes. The invention in particular focuses on

- the process of transferring the winding material from a wound bobbin or package on a first spindle to an empty bobbin tube on a second spindle,
- the catching process of the winding material at the second spindle and/or
- the cutting process for the winding material at the start of the winding process for the package to be built at the second spindle.

Furthermore, the present invention relates to a method for controlling a winding machine during the afore mentioned processes.

BACKGROUND OF THE INVENTION

It is possible to provide winding material (in particular threads or other elongate goods as yarns, wires or ribbons) by an extrusion process, by a spinning process or by taking the winding material from another bobbin. By means of the winding machine the winding material is wound (in particular on an empty bobbin tube) to a wound package for building a bobbin. In the sense of the present invention a "continuously" fed winding material covers any winding material having a length longer than at least the length of the winding material wound in one single package. After the winding process of a first wound bobbin at the winding machine the bobbin is used for transportation purposes and then at a remote location as a source of the winding material for another process requiring the winding material.

In known winding machines the winding material is fed via one single or a plurality of fixed or movable rolls to a traversing device holding a traversing guide. The traversing guide is controlled for moving with a traversing movement in a traversing direction having an orientation parallel to the spindle axes. By

- appropriate choice of the drive velocity of the spindle itself or a pressure roller building a frictional drive for the bobbin and
- the velocity of the traversing movement of the traversing guide
- as well as dimensioning the maximal displacement of the traversing guide different winding patterns, a fixing winding and/or a reserving winding and an oscillating stroke of the traversing guide can be produced during the winding process.

Modern winding machines comprise at least two winding stations with associated spindles for successively and alternating winding bobbins at these winding stations. Here, special attention is to be paid to an automated continuous change from one winding station with a completely wound bobbin (in the following also "first winding station") to another winding station where the winding process is to be initiated (in the following also "second winding station"). The automated change or transfer requires a transfer of the winding material from the first winding station to the second winding station, the catching and holding of a part of the winding material at the second winding station and the separating or cutting process for the winding material between the two winding station.

Winding machines of a type generally differing from the type of winding machine according to the invention are built with a revolver rotatable around its longitudinal axes (see DE 102 23 484 B4, DE 10 2006 054 980 B4 and DE 26 43 271 A1). The revolver holds a plurality of spindles rotating around their spindle axes. With a rotation of the revolver the spindle axes are additionally rotated around the longitudinal axis of the revolver. For winding machines of this type the bobbins are wound at the same fixed location by moving the first and second winding station successively into this fixed location by a rotation of the revolver. Winding machines basing on the principle of a revolver require separate drives for the traversing device, the traversing guide, the spindles and the revolver. Accordingly, these types of winding machines require an additional drive causing

- the need for additional constructive space,
- additional costs and
- the need for an additional control of the drive for the revolver with a correlation of such control with the control of the other mentioned drives.

On the other hand winding machines basing on a revolver provide the possibility that the winding material is cut in dependence on the rotation of the revolver for a change from one winding station to another winding station. According to DE 26 43 271 A1 with the rotation of the revolver the winding material is moved and pulled against a cutting blade. Such a possibility for controlling the cutting process is not given for winding machines of the present type with fixed spindle axes.

WO 2008/020070 A1 discloses a winding machine of the inventive type with fixed spindles. These spindles have a parallel orientation. The spindles are driven separately from each other. The two spindles are driven in opposite rotational directions. The winding machine comprises a traversing device fixed at a frame. A traversing guide is guided and driven for a traversing movement in a traversing direction having an orientation parallel to the spindle axes. The winding material is fed via two fixed and a movable roll building a dancer-control. The drive aggregate for driving the spindles is controlled in dependence on a displacement of the movable dancer-roll. After finishing the winding process of the first package in the first winding station it is necessary to manually cut the winding material and to manually wind the free end of the winding material three to five times around the empty bobbin tube. The mentioned manual steps require an operator caring full time for the winding machine and might cause the risk of injuries.

U.S. Pat. No. 5,522,560 discloses a winding machine with two coaxial winding stations. For a change of one winding station to the other a separately controlled and moved transportation element as well as a separate controlled and moved cutting blade for cutting the winding material is used.

EP 0 018 577 discloses a winding machine comprising two winding stations. The winding material is transferred by a separately controlled and moved transportation element to a redirecting hook which is located close to the spindle axis of an empty bobbin tube. The spindle comprises a catching device used for transferring the winding material from the redirection hook to the empty bobbin tube. The traversing device disclosed in this document comprises only one degree of freedom for the traversing movement of the traversing guide.

DE 20 37 282 C3 discloses a winding machine for a winding material built by a wire. For the disclosed embodiment the traversing device both comprises a degree of freedom for a traversing movement parallel to the spindle axes as well as an additional degree of freedom transverse to the spindle axes used for transferring the winding material from a first winding station to a second winding station. The winding material is caught by a clamping and cutting device. For catching the winding material according to one embodiment a roll or bolt is moved out for redirecting the winding material versus the clamping and cutting device. For another embodiment the document discloses the provision of the spindles with an additional degree of freedom along the spindle axes. For this embodiment the catching process of the winding material is controlled by axially displacing the spindles along their additional degree of freedom.

Document DE 37 34 478 C2 discloses the use of a cutting blade moved by a magnet for cutting the winding material during the change of the winding process from one winding station to another.

It is an object of the present invention to provide an improved winding machine comprising spindles with fixed axes.

Another object of the present invention is to ease an automated change of the winding station for a continuously fed winding material.

Furthermore, it is an object of the present invention to increase the process reliability, the process safety and/or the process stability.

Another object of the present invention to provide an improved method for the control of a winding machine.

SUMMARY OF THE INVENTION

The present invention relates to a winding machine comprising at least two driven spindles. The at least two spindles might be driven separately from each other or by a common drive. Furthermore, the spindles might be directly driven by at least one drive aggregate, wherein also at least one transmission unit might be used between the drive aggregate and at least one of the spindles. However, it is also possible that the spindles or bobbins are indirectly driven be a frictional drive or pressure roller pressed against the outer circumference of the bobbin.

The spindles comprise fixed and parallel spindle axes defining a spindle plane. In case of more than two driven spindles being provided all of these spindles might be lying within the same spindle plane or only two spindles build a common spindle plane respectively.

Furthermore, according to the invention a traversing device is provided. The traversing device comprises a traversing guide which is positionable along a traversing direction which is (approximately) parallel to the spindle axes. Accordingly dependent on the position of the traversing guide with respect to the other parts of the traversing device the position of the traversing guide relative to the spindle axes can be changed. The traversing movement of the traversing guide builds a first degree of freedom used for moving the section of the winding material interacting with the traversing guide.

Furthermore, according to the invention the traversing device (and with the traversing device also the traversing guide) is movable transverse to the spindle axes in a changing direction providing a second degree of freedom. This degree of freedom might be linear or might have any curved shape. With the control of the two degrees of freedom the traversing guide can be driven for a complex movement within an even or curved plane defined by the traversing direction and the changing direction.

According to the invention a transfer device is provided used during the transfer and change from one winding station to another. To name some examples in the following some possible functions of such transfer device are listed that might be used in alternative or cumulative sense: the transfer device might be used for

- guiding the winding material away from a first completely wound package;
- redirecting the winding material between the two winding station;
- avoiding that winding material guided away from the wound package is again caught by this bobbin, the bobbin tube or a catching device associated with the wound bobbin;
- cutting or separating (in the following "cutting") the winding material during or after the change from a wound package at the first winding station to an empty bobbin tube at a second winding station;
- redirecting, displacing or holding the winding material such that it is possible that the winding material is caught by an empty bobbin tube, the second spindle or associated components at the second winding station.

According to the invention the transfer device is not held by a controlled device having an actor for moving the transfer device. In the simplest case the transfer device is rigidly fixed at a frame or base plate. However, the feature "the transfer device having a fixed position with respect to said spindle axes" might also cover embodiments wherein the transfer device is held with some elasticity.

The inventions suggests using a control device which might be built by one single or a plurality of control units. The control device is designed and arranged and programmed such that the winding material for a change of the winding station is "retrieved" from the wound bobbin at the first spindle, is brought into engagement with the transfer device (where the winding material might be redirected) and is then transferred to the empty bobbin tube at the second winding station or to a catching device associated with the winding station or second spindle. For that aim the control device controls both the movement of the traversing device transverse to the spindle axes as well as of the traversing guide parallel to the spindle axes.

According to the invention the need of an actuator for causing any movement of the transfer device does not exist. Furthermore, according to one embodiment of the invention, a control of a transportation device for the winding material for the change from one winding station to another and/or a catching hook and the like might be avoided leading to a further simplification of the winding machine in the control.

It is also possible that according to the invention it is possible to provide the transfer of the winding material from the wound bobbin at the first winding station to the empty bobbin tube at the second winding station by pure control of the movements of the traversing device and traversing guide (in particular with additional control of the rotational movement of the spindles). For this embodiment it is possible to use the degrees of freedom of the traversing device and the traversing guide in a multifunctional way, i. e. during the winding process itself and for the transfer of the winding material between the different winding stations.

For another embodiment the invention suggest positioning the transfer device between the spindle axes when seen in a projection into the spindle plane. In this projection plane the transfer device is located in front of or behind the bobbin tubes when seen along the spindle axes. For this embodiment the transfer device is located remote from the area used during the normal winding process and only comes into play in case of moving the traversing guide out of the intermediate space between the wound bobbin and the empty bobbin tube.

For another embodiment of the invention the mentioned degrees of freedom of the traversing device and the traversing guide can be used for bringing the traversing guide into a catching position. In this catching position the path of the winding material between the transfer device and the traversing guide passes a catching region of a catching device for automatically catching the winding material at the second winding station. Furthermore, it is possible that the winding material is caught by the catching device at a point in time defined by the traversing guide reaching the catching position. However, it is also possible that the catching device is moved versus the winding material with a time delay after the traversing guide has reached the catching position. This delayed movement might be dependent on a rotation of the catching device with the spindle towards the winding material.

According to another embodiment of the present invention during the changing process the winding material in a first approximation follows a V-shaped path between the wound package and the empty bobbin tube when seen in a projection into the spindle plane. For this embodiment the transfer device is located at the tip of the V. By means of the "V"-shaped path between the two spindles the winding material is guided out of the intermediate space between the two winding stations.

For a simple embodiment it is possible that the transfer device is built by a single redirecting bolt or roll such that a redirecting surface of the redirecting device comprises a contour of segment of a circle. However, for another embodiment the transfer device might comprise two redirecting surfaces for redirecting the winding material in opposite directions. For this embodiment it is possible that the redirected surfaces have a shifted location when seen along the spindle axes. This embodiment might lead to the following advantages:

In case of transferring winding material from the wound package at the first winding station it might be of advantage to position the first redirecting surface close to the intermediate space between the wound package and the empty bobbin tube. The reason for this is that with an increase of the distance of the redirecting surface from the intermediate space the angle of the winding material with respect to the circumferential direction of the wound bobbin increases resulting in an undesired change of the angle of the last winding of the package. Another possible disadvantage is that with an increase of the distance of the first redirecting surface from the intermediate space there is an increasing risk that the free end of the cut winding material rotates with the wound bobbin. Furthermore there is the likelihood of this free end being re-caught by the wound package or the related filled bobbin tube at the first winding station.

On the other hand it is of interest to locate the catching region of the catching device at the second winding station with a predetermined minimum distance from the intermediate space between the wound package and the empty bobbin when seen along the spindle axes. In order to guarantee the minimum distance it is of advantage to use the second redirecting surface in the path of the winding material from the first redirecting surface to the catching device.

The two above demands can be considered by use of two redirecting surfaces having shifted locations.

In general for the cutting or separation of the winding material after catching the same at the second winding station any known separating or cutting device at any position might be used. According to one embodiment of the invention the automatic cutting of the winding material is done by a cutting device located at the transfer device so that the transfer device and the cutting device have a compact design. In particular the transfer device and the cutting device build one single assembly unit or an integral component.

It is possible that the cutting device is moved by a controlled actuator. However, according to another embodiment of the invention the cutting device, in particular a cutting blade, has a fixed location.

For one embodiment of the invention the transfer device is built with two rods building an acute angle. In particular the acute angle between the two rods is between 10° and 30°. By control of the movement of the traversing guide with traversing device along the two mentioned degrees of freedom the winding material is introduced into the intermediate space between the two rods. Respective circumferential surfaces of the two rods might built the two aforementioned redirecting surfaces with the above mentioned advantages and purposes. By dimensioning the diameters of the rods at the redirecting surfaces and by adjusting the orientation of the two rods in the projection into the spindle plane, the shift of the locations of the two redirecting surfaces might be provided and adapted. By means of the use of the two rods building an acute angle the process reliability of the inventive winding machine might be increased due to the fact that the "V"-shaped rods build a type of introducer or a kind of funnel for the winding material.

After the winding material has come into contact with the transfer device, has been transferred to the second winding station and has been caught by the catching device at the second winding station it is necessary to cut the winding material. For this cutting process a relative movement is necessary between the cutting device and the winding material bringing the winding material into contact with the cutting device. It is possible to provide this relative movement according to the prior art explained above by moving the cutting device by a controlled actuator. However, according to another embodiment of the invention the relative movement is caused by a rotation of the catching device at the second winding station. To say it in other words for this embodiment the catching device with its rotation presses or pulls the winding material under tension against the cutting device for cutting the winding material. For this embodiment the catching device is used in a multifunctional way, i. e. both for catching, holding and/or clamping the winding material and for causing the necessary relative movement during the cutting process.

In a method according to the present invention the control might be eased by only controlling a traversing device, a traversing guide and/or the drive of the spindles for transferring the winding material from a wound package via the transfer device to the second winding station. With the mentioned two degrees of freedom of the traversing device and traversing guide the complex movement of the traversing guide and the winding material is provided without additional actuators, transportation elements and the like being mandatory. For one embodiment of the invention also the cutting of the winding material for an inventive method is only controlled by controlling the traversing device, the traversing guide and/or the drive of the spindles.

For another embodiment of the inventive method the traversing guide is moved with a traversing movement in front of or behind the fist wound package when seen along the spindle axes for bringing the winding material into interaction with the transfer device. Subsequently the traversing guide is controlled for the traversing guide returning back in traversing direction in opposite direction. During this forward and backward traversing movement of the traversing guide the traversing device is controlled for moving in changing direction (i. e. a movement transverse to the traversing direction of the traversing guide). By this changing movement the traversing guide is moved from the first winding station to the second winding station. The pure control of the movement of the traversing guide and the traversing device might cause a complex movement used for transferring the winding material from the wound package, bringing the winding material into interaction with the transfer device and transferring the winding material to an empty bobbin tube at the second winding station.

For another embodiment of the inventive method a catching device is rotated with the second spindle. The interaction with the winding material and the catching device is established by rotating the second spindle with associated catching device to a predetermined angle of rotation. At the same time or with a time shift the traversing guide is moved into a position for which a segment of the winding material extending between the transfer device and the traversing guide passes through a catching region of the catching device.

For another embodiment of the invention separate actuators and controls for cutting the winding material might be dispensable. For this embodiment the relative movement between a cutting device with a fixed location and the winding material for cutting the winding material is only caused by a rotation of the spindle with the associated catching device.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
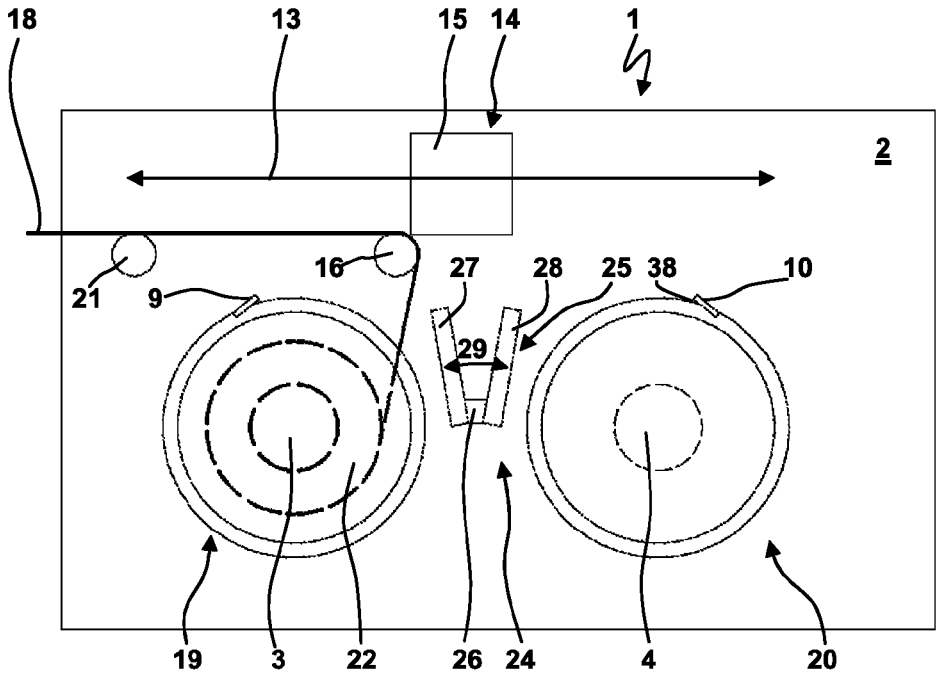
FIG. 1 is a schematic front view of a winding machine at the end of the winding process of a package at a first winding station.

The schematic figures show a winding machine 1 having a vertical base plate 2 having a fixed location and being used for supporting, bearing and/or guiding other components of the winding machine 1. Two parallel spindles 3, 4 with a horizontal orientation, so an orientation vertical to the base plate 2, are directly or indirectly driven by at least one drive aggregate (not shown) for a rotation around the spindle axes 5, 6. The spindles 3, 4 each comprise at least one flange 7, 8 wherein the flange 7, 8 might be an integral part or an additional component fixed with a base body of the spindles 3, 4. Clamping, catching or holding devices 9, 10 (in the following "catching device") are located at the outer surfaces of the flanges 7, 8. The catching devices 9, 10 are fixed to the spindles 3, 4 or to the related bobbin tube so that the catching devices 9, 10 are rotated with a rotation of the bobbin or spindles 3, 4. The spindles 3, 4 extend through respective bobbin tubes 11, 12 establishing a drive connection between the spindles 3, 4 and the bobbin tubes 11, 12 in a way known for the person with skill in the art.

Figure 2:
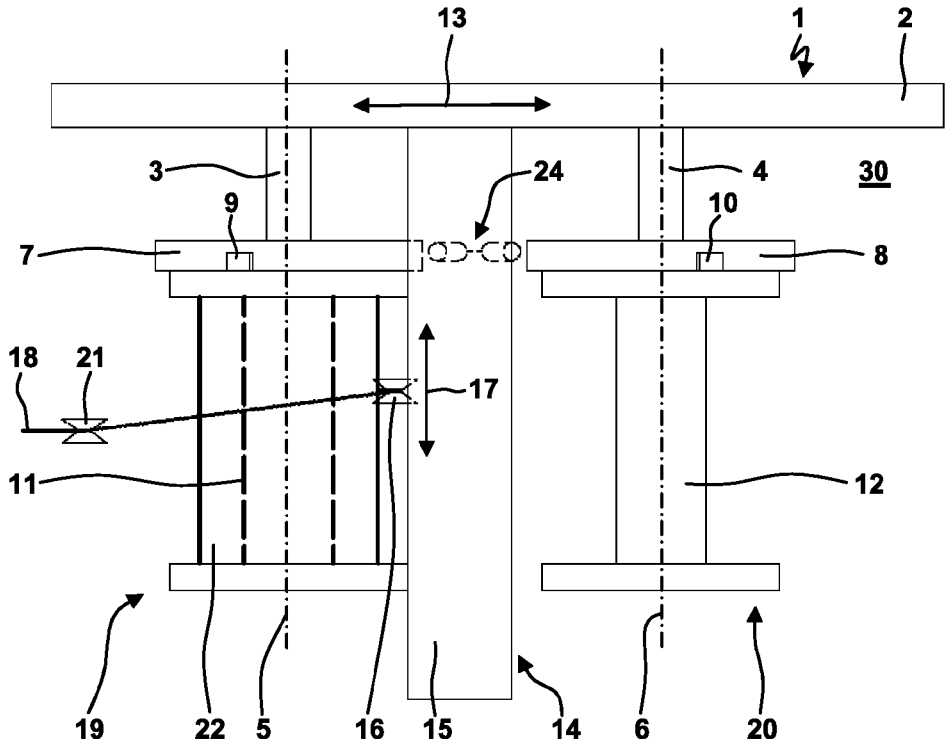
FIG. 2 shows the winding machine according to FIG. 1 in a plan view.

A traversing device 14 is held by the base plate 2 and guided with respect to the base plate 2 with a degree of freedom in a changing direction 13. In FIG. 1 the changing direction 13 corresponds to a translational degree of freedom. However, differing from the figures the degree of freedom for the changing direction 13 might also be a curved degree of freedom. In any case the changing direction 13 has (at least in the relevant section) an orientation transverse to the spindle axes 5, 6. The traversing device 14 is moved in changing direction 13 by a controlled device (not shown) controlling an actuator (not shown) which might be any suitable actuator, in particular an electrical drive, a hydraulic or pneumatic actuator and the like. The traversing device 14 comprises a guiding unit or guidance 15 having an orientation parallel to the spindle axes 5, 6. A traversing guide 16 is guided by the guiding unit 15 for a movement in a traversing direction 17 having an orientation parallel to the spindle axes 5, 6. The movement of the traversing guide 16 is controlled by the aforementioned control device (not shown) or another control device that might communicate with the aforementioned control device. The movement of the traversing guide 16 is caused by an actuator (not shown). The two degrees of freedom (i. e. the movement in traversing direction 17 and in the changing direction 13) has the result that also for the translational degree of freedom of the traversing device as shown in FIG. 1 any movement of the traversing guide 17 in a plane having an orientation parallel to the drawing plane of FIG. 2 is possible. Here any curved movement in the mentioned plane might be controlled by the control unit(s) controlling the two involved actuators. The traversing movement in the traversing direction 17 is used for winding the winding material 18 with a predetermined pattern on the bobbin tube 11 at the first winding station 19. The traversing movement in the traversing direction 17 is also used during the change from the winding process at the first winding station 19 to the winding process at the second winding station 20. The winding material 18 is continuously fed (e. g. via a fixed roll 21 and the traversing guide 16) to the bobbin tube 11, 12 or to the at least partially wound package 22, 23. A guidance and an axial limitation of the packages 22, 23 might be provided by the flanges 7, 8.

The inventive winding machine 1 comprises a transfer device 24. For the shown embodiment the transfer device 24 comprises a redirecting device 25 and a cutting device 26, here integrated in a common unit. The redirecting device 25 is built with two rods 27, 28. In the drawing plane according to FIG. 1 the rods 27, 28 have a V-shaped orientation wherein the longitudinal axes of the rods 27, 28 build an acute angle 29. The angle 29 lies in particular in the range of 10° to 30°. The V-shaped redirecting device 25 is open in upper direction. At the tip of the V or at the connection of the two legs, so in the lower end regions of the rods 27, 28, the cutting device 26 is located. In its simple form the cutting device 26 is built by a cutting blade or knife, wherein the cutting edge faces upwards. The cutting edge has an orientation parallel to the drawing plane according to FIG. 1. The cutting edge extends between the two rods 27, 28. As can be seen from FIG. 2 the V-shaped rods 27, 28 define a plane having an orientation parallel to the base plate 2. The plane defined by the rods 27, 28 approximately corresponds to the plane wherein the flanges 7, 8 extend or the two mentioned planes have only a small distance. The transfer device 24 is positioned approximately or exactly in the middle between the two spindle axes 3, 4. The spindle axes 3, 4 define a spindle plane 30. The traversing device 14 with the traversing guide 16 is located vertically with a small distance above the transfer device 24, in particular with a distance smaller than 0.5 cm, 2 cm, 4 cm or 8 cm The upper end regions of the rods 27, 28 are approximately located in the highest position that the catching devices 9, 10 reach with the rotation of the spindles 3, 4.

The reference numerals for the components described above are only marked in FIGS. 1 and 2. FIGS. 1 to 12 show six steps of the method for the change or transfer of the winding process from the first winding station 19 to the second winding station 20, wherein pairs of figures show a front view (odd numbers of the figures) and a corresponding plane view (even numbers of the figures). FIGS. 1 and 2 show the end of the winding process of a bobbin at the first winding station 19 with a completed package 22. The end of the winding process for the package 22 might be determined and controlled in dependence on a sensed weight of the package material, a measured or estimated length of the winding material on package 22 or dependent on the revolution numbers or the time consumed during the winding process.

Figure 3:
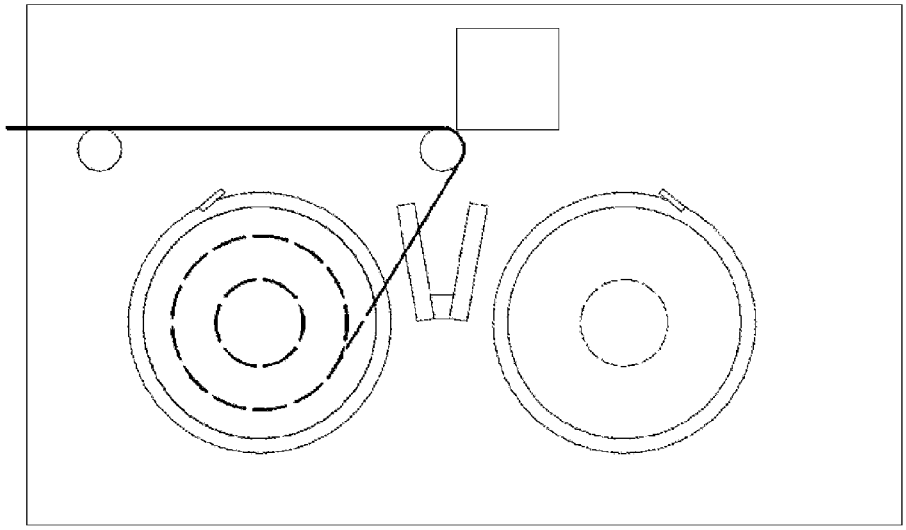
FIG. 3 shows the winding machine according to FIGS. 1 and 2 in a schematic front view after finishing the winding process of the package at the first winding station and controlling the traversing device and the traversing guide for guiding the winding material through a transfer device.
Figure 4:
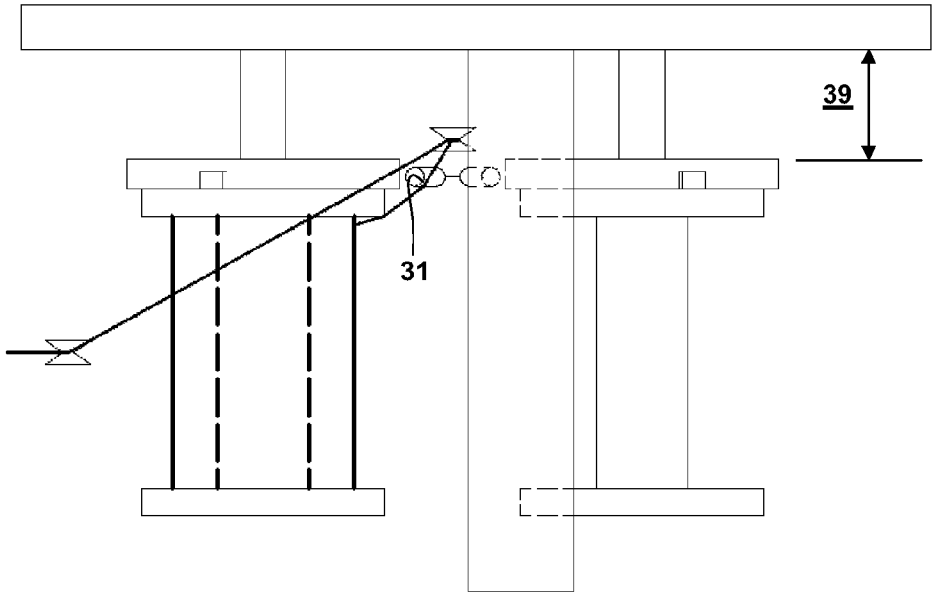
FIG. 4 shows the winding machine according to FIG. 3 in a plan view.

For the next step according to FIGS. 3 and 4 the traversing device 14 is first moved in changing direction 13 such that the traversing guide 16 is located in the middle between the spindle axes 3, 4. At the same time or subsequently, the traversing guide 16 is moved in traversing direction 17 along the guiding unit 15 towards the base plate 2 and the transfer device 24. Finally the components reach their positions according to FIG. 4. The traversing guide 16 when seen from the base plate 2 along the traversing direction 17 is now positioned in front of the bobbin tubes, the flanges 7, 8 and the transfer device 24. Due to the fact that the traversing guide 16 is positioned vertically above the transfer device 24 it is possible that the traversing guide 16 passes the transfer device 24 without a collision. During this movement the winding material extends from the lower side of the bobbin in upward direction to the traversing guide 16. With the movement of the traversing guide 16 versus the base plate 2 the angle of the winding material built with a horizontal plane decreases so that the winding material enters in downward direction into the V-shaped redirecting device 25. The winding material 18 is introduced into the transfer device 24, in particular between the two rods 27, 28. As can be seen from FIG. 4 the rod 27 being positioned closer to the first winding station 19 finally comes into contact with the winding material 18 in the redirecting region 31. In the redirecting region 31 the winding material 18 is redirected in counterclockwise direction in FIG. 4. With a further movement of the traversing guide 16 in traversing direction the redirecting region 31 moves along the longitudinal axes of rod 27 in downward direction. In FIGS. 3 and 4 the traversing guide 16 is located in the middle between the two spindle axes 3, 4 and in the end position in traversing direction 17 being located closest to the base plate 2.

Figure 5:
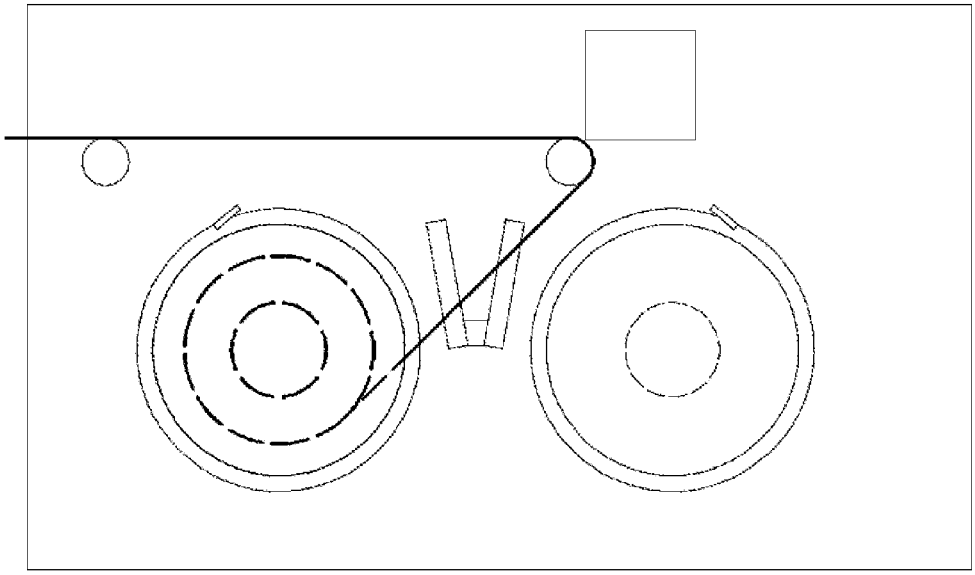
FIG. 5 shows the winding machine according to FIGS. 1 to 4 in a schematic front view after a further movement of the traversing device and traversing guide for the preparation of a change from a first winding station to a second winding station.
Figure 6:
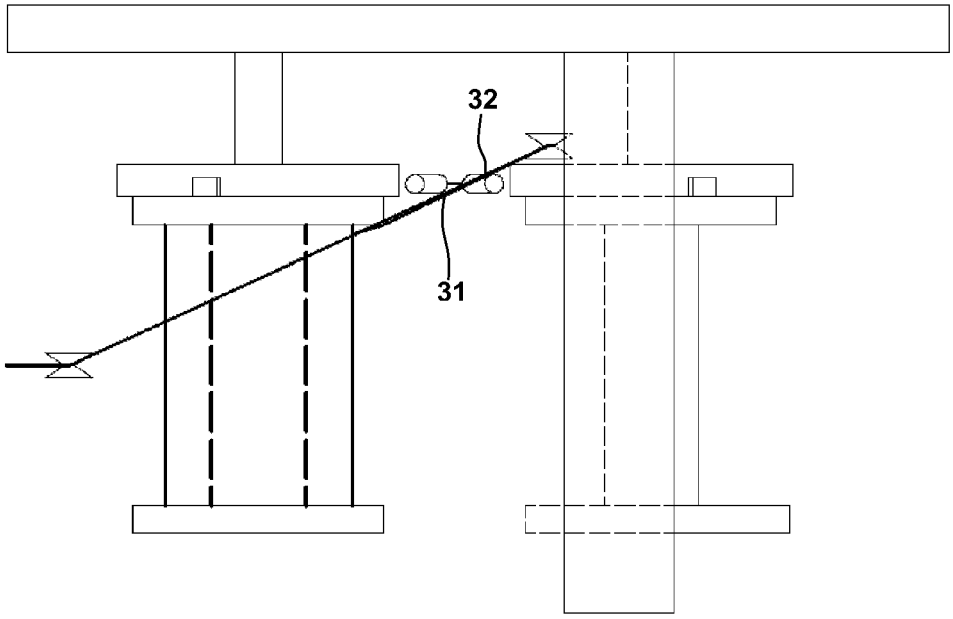
FIG. 6 shows the winding machine according to FIG. 5 in a plan view.

In the next step the traversing guide 16 is not moved in traversing direction 17. Instead the traversing device 14 is moved in changing direction 13 away from the first winding station, so to the right in FIG. 4 into the position of the traversing guide 16 shown in FIGS. 5 and 6. In this position the winding material 18 additionally contacts the redirecting device 25 at a redirecting region 32. In this redirecting region 32 the winding material 18 is redirected in FIG. 6 in clockwise sense, so in opposite direction to the redirection in the redirecting region 31. Accordingly, within the redirecting device 25 the path of the winding material 18 can be describes as S-shaped. in a first approximation. Due to the additional movement in changing direction 13 the winding material 18 further moves in the redirecting device 25 in downward direction towards the cutting device 26 with a remaining distance between the cutting device 26 and the winding material 18 (c. p. FIGS. 3 and 5).

Figure 7:
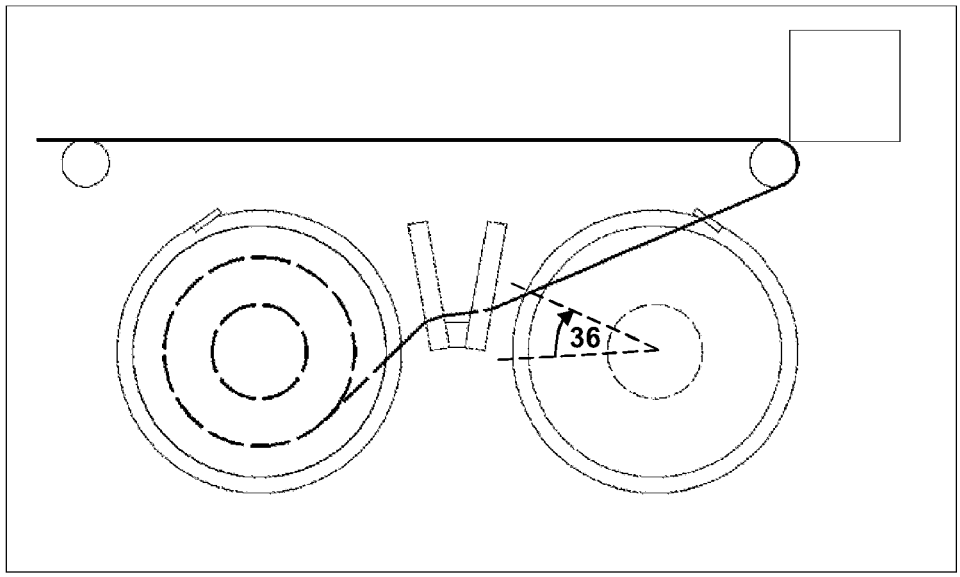
FIG. 7 shows the winding machine according to FIGS. 1 to 6 in a schematic front view after a movement of the traversing device with the traversing guide into a catching position in the neighborhood of an empty bobbin tube at the second winding station wherein the winding material is redirected by the transfer device.
Figure 8:
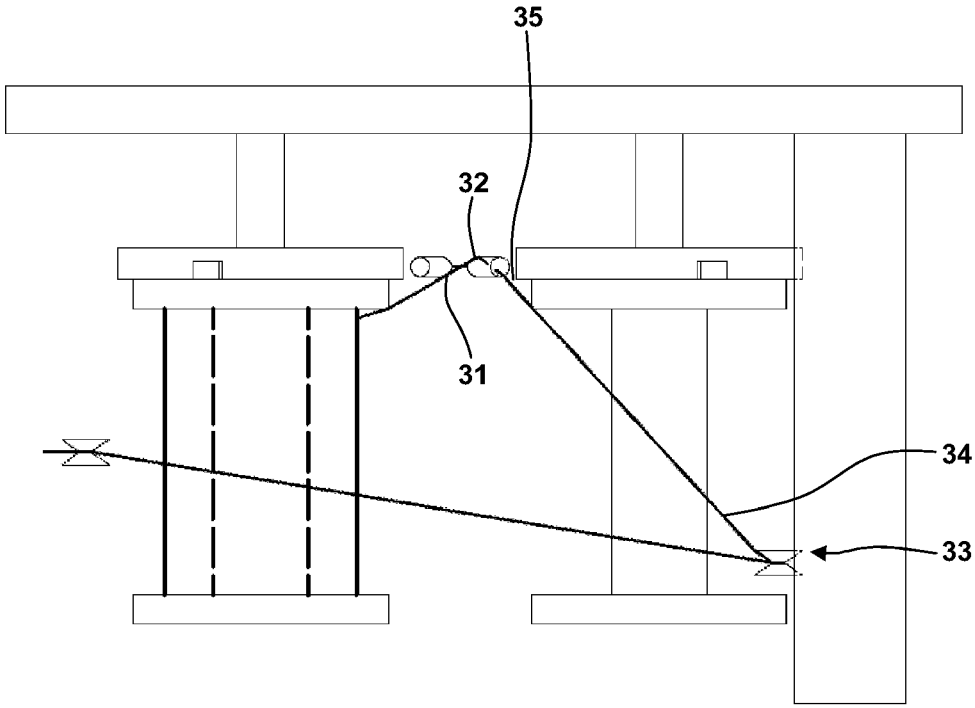
FIG. 8 shows the winding machine according to FIG. 7 in a plan view.
Figure 9:
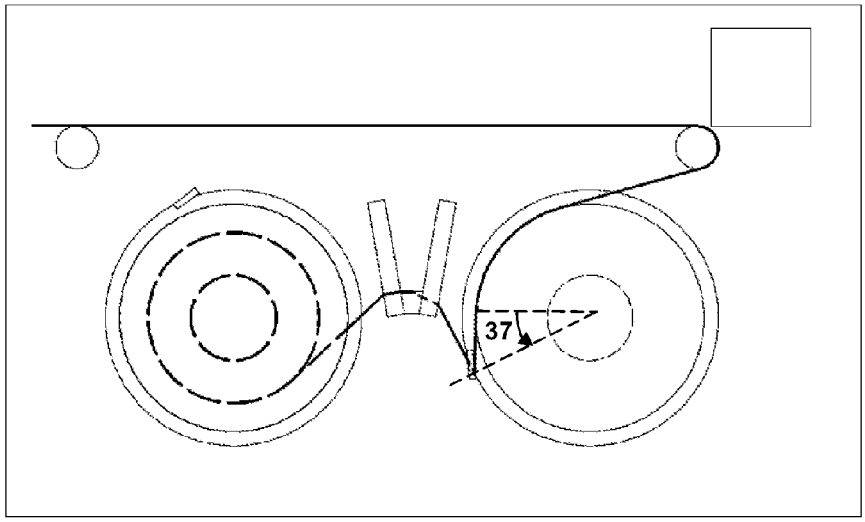
FIG. 9 shows the winding machine according to FIGS. 1 to 8 in a schematic front view after a movement of the winding material towards a cutting device by a rotation of the catching device with the spindle at the second winding station.
Figure 11:
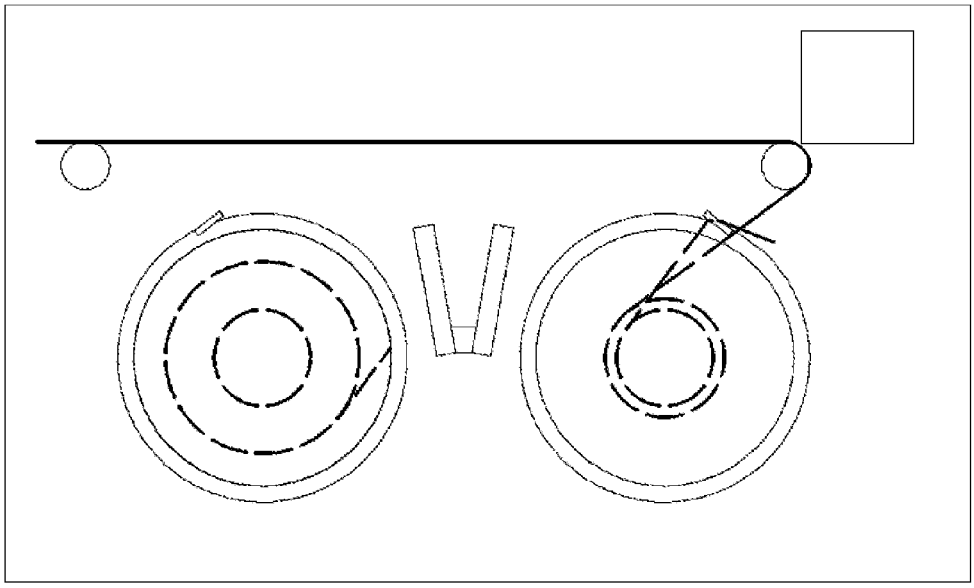
FIG. 11 shows the winding machine according to FIGS. 1 to 10 in a schematic front view after the cutting process of the winding material wherein a lose end of the winding material is held by the catching device at the second winding station, the winding machine shown after winding a starting winding at the second winding station.
Figure 12:
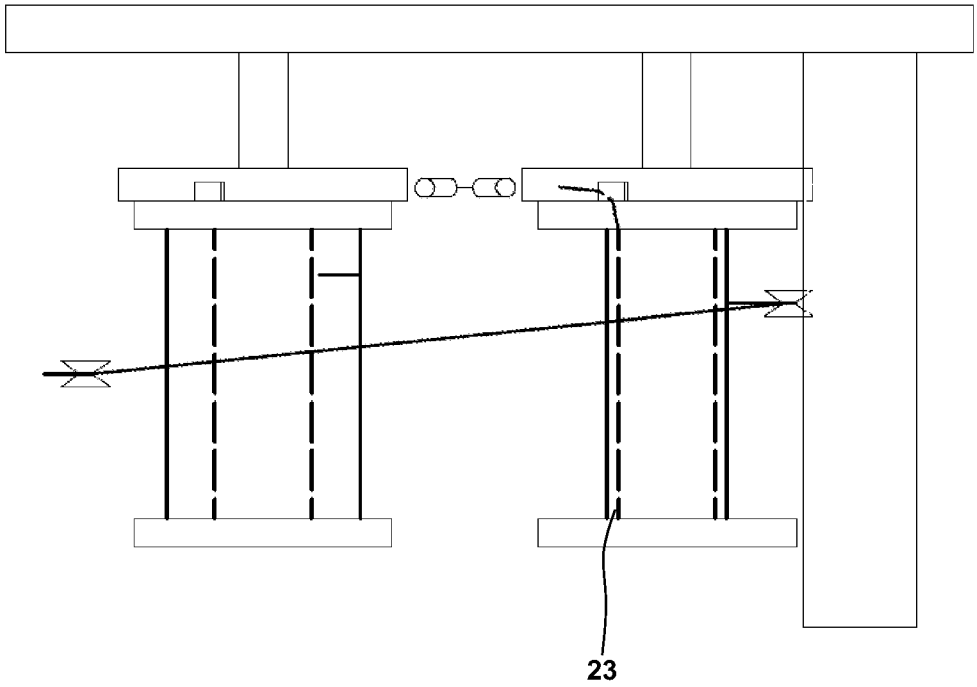
FIG. 12 shows the winding machine according to FIG. 11 in a plan view.

In a subsequent step shown in FIGS. 7 and 8 the traversing guide 16 is moved to a catching position 33. The catching position is chosen such that a segment 34 of the winding material 18 extending between the transfer device 24 or redirecting device 25 and the traverse guide 16 comprises a small distance 35, in particular a distance smaller than 0.5 cm, from the outer circumference of flange 8. This is the case for an angle of rotation 36 of flange 8 which for the shown embodiment in FIG. 7 approximately corresponds to a 10 o'clock position. With a further rotation of the spindle 4 with flange 8 and catching device 10 the catching device 10 moves to another angle of rotation 36. With this angle of rotation 36 the catching device catches, clamps and/or holds (in the following "catches") the winding material 18. With the subsequent movement of spindle 4, flange 8 and catching device 10 the catching device 10 transfers the winding material 18 downward (see FIGS. 9 and 10). Whereas before the winding material 18 was located with a small distance from the separating device 26, the aforementioned movement of the winding material 18 in downward direction caused by the rotating catching device 10 has the effect that the winding material 18 is pressed or pulled against the cutting device 26. For a sufficient pulling force and tension of the winding material 18 with a further movement of the catching device in downward direction the winding material 18 is cut by the cutting device 26. The cutting of the winding material 18 takes place at a second angle of rotation 37. Once cut a freed end of the winding material 18 is still held by the catching device 9. With the driven rotation of the spindle 4 and associated elements and suitable traversing movement of the traversing guide 16 now the winding process of an increasing package 23 is initiated at the second winding station 20 (FIGS. 11 and 12).

The person with skill in the art will know that according to the above described procedure an additional change from a second winding station 20 might be initiated to a third winding station (not shown) after finishing the package 23 at the second winding station 20. However, it is also possible that the winding material 18 is returned to the first winding station 19 when finishing the package 23 at the second wining station 20. During the process of winding the package 23 at the second winding station the finalized package 22 at the first winding station 19 is removed and a new empty bobbin tube 19 is placed upon the spindle 3.

For the shown embodiments the spindles 3, 4 are driven in opposite directions. For this embodiment the winding material 18 is fed to the spindle 3 from the lower side whereas to spindle 4 the winding material is fed from its upper side.

Figure 10:
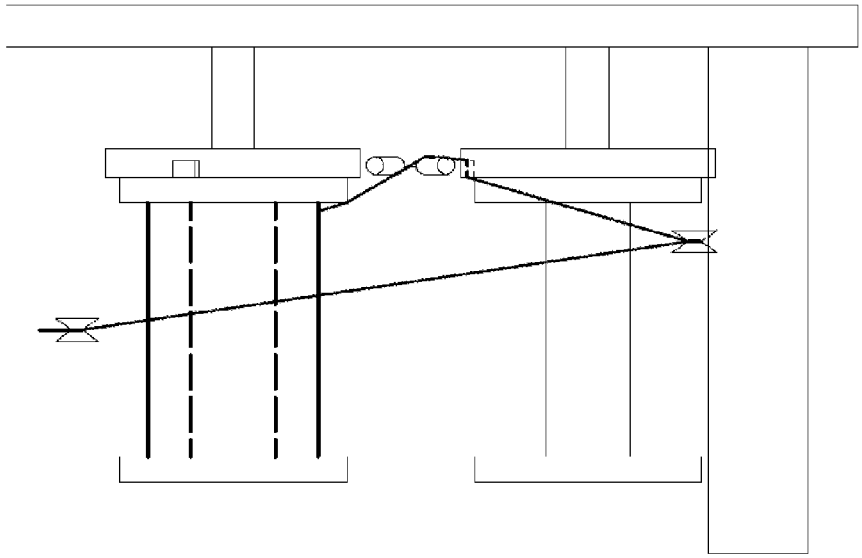
FIG. 10 shows the winding machine according to FIG. 9 in a plan view.

Referring now in greater detail to FIG. 10 a possible function of the redirecting regions 31, 32 will be explained. The redirecting region 31 of the rod 27 located closer to the first winding station 19 should be located so far in the direction of the intermediate space between the two bobbins and so far away from the base plate 2 that the redirecting region 31 guarantees that the angle of the winding material 18 at the last winding on the bobbin is not changed with an undesired extent. On the other hand the redirecting region 31 guarantees that there is no undesired interaction between the winding material 18 and flange 7. Furthermore, the redirecting region 31 guarantees that the winding material 18 is not caught again by the catching device 9 of the first winding station 19. The redirecting region 32 builds an end point of segment 34 during the catching process of the winding material 18 by the catching device 10. The position of this end point should be located close enough to the base plate 2 to guarantee that the winding material 18 in the segment 34 passes flange 8 with a distance small enough for the catching device 10 being able to catch the winding material 18.

The aforementioned two objects of the redirecting regions 31, 32 might be fulfilled by dimensioning the diameters of the rods 27, 28 as required. Furthermore, it is possible to rotate the redirecting device 25 from its horizontal orientation of FIG. 10 in counterclockwise direction for increasing the distance of the redirecting region 31 from the base plate 2 and decreasing the distance of the redirecting region 32 from the base plate 2. However, this might not be useful in case of also a retransfer of the winding material 18 from the second winding station 20 to the first winding station 19 being necessary. In this case also two redirecting devices 25, 25*a* (each being built by a pair of rods 27, 28, 27*a*, 28*a*) might be positioned one behind another in traversing direction 17. For this embodiment the change from the first winding station 19 to the second winding station 20 leads to a redirection in a redirecting region 31 of rod 27 of the first redirecting device 25 whereas the redirecting region 32*a* is built by rod 28*a* of the second redirecting device 25*a*. For the change back from the second winding station 20 to the first winding station 19 the other rods 27*a*, 28 of the redirecting devices 25, 25*a* build the redirecting regions 31*a*, 32.

The person with skill in the art will know that during the change from one winding station to another any movement of the traversing guide 16 is possible. Any controlled movement of the traversing guide 16 also differing from the movements described above should be covered by the present invention. It is only of importance that during the change from one winding station to another the traversing guide 16 brings the winding material 18 in contact or into interaction with the transfer device 24. In particular the winding material 18 is passed through the redirecting device 25. This requires that the traversing guide 16 is moved into the end position shown in FIG. 4. In this end position the traversing guide 16 is located at the side of the transfer device 24 facing away from the bobbins. The movement of the traversing guide 16 might in a first approximation be described as a V-movement (in a projection into the spindle plane). The tip of the V corresponds to the aforementioned end position of the traversing guide 16. The two legs of the V might have differing angles with respect to the traversing direction 17.

The rods 27, 28 might be optimized for their contact with the winding material 18 and the necessary relative sliding movement between the winding material 18 and the rods 27, 28. In particular, the rods 27, 28 are, at least in the redirecting regions, covered by an antifriction layer. Furthermore it is possible that the rods 27, 28 are built with sleeves beared by pins extending through these sleeves.

The catching devices 9, 10 might comprise an elastic element for clamping the winding material 18 when caught.

The flanges 7, 8 comprise a diameter which is in particularly slightly larger than the maximum diameter of the produced packages 22, 23. Accordingly the catching devices 9, 10 are located at a radius which is slightly larger than the radius of a produced package 22, 23.

For an alternative embodiment in the position reached according to FIG. 8 by the traversing guide 16 is not in the catching position 33. For this embodiment the traversing guide 16 is moved towards the end position in traversing direction with the maximum distance from the base plate 2. The traversing device 14 is driven into a position for the later winding process for the empty bobbin tube. In this position also with a rotation of spindle 4 with catching device 10 it is not possible that the winding material 18 is caught by the catching device 10. With a subsequent movement of the traversing guide 16 in traversing direction 17 towards the base plate 2 it is possible to bring the winding material 18 closer to flange 8. Finally the winding material 18 extends through the catching region 38 of the catching device 10. The winding material 18 once caught by the catching device 10 is with increasing velocity wound according to an increasing rotational velocity of spindle 4.

In case of the rotational velocity of spindle 4 not being changed in a sufficient extent differences between the velocity of the circumference of the bobbin or package and the fed winding material might be balanced by controlling the velocity of the traversing guide 16 in traversing direction 17.

Subsequent to the cutting of the winding material 18 by the cutting device 26 the bobbin at the first winding station 19 is decelerated and stopped and the wound bobbin or package is exchanged with an empty bobbin tube.

Flanges 7, 8 might be positioned with a distance 39, in particular a distance of at least 3.5 of 10 cm, from the base plate 2 for providing enough space for a movement of the traversing guide 16 behind the transfer device 24 for introducing the winding material 18 in downward direction into the transfer device 24.

It is also possible that the traversing device 14 comprises another degree of freedom with an associated actuator. This additional degree of freedom might have an orientation vertical to the traversing direction 17 and to the changing direction 13.

Many variations and modifications may be made to the preferred embodiments of the invention without departing substantially from the spirit and principles of the invention. All such modifications and variations are intended to be included herein within the scope of the present invention, as defined by the following claims.

We claim:

1. Method for controlling a winding machine for winding a continuously fed winding material on bobbin tubes to wound packages, said winding machine comprising two driven spindles, said spindles rotating around fixed and parallel spindle axes, said spindle axes defining a spindle plane, a traversing device holding a traversing guide, said traversing guide being driven for a traversing movement along said traversing device along a traversing direction having an orientation parallel to said spindle axes and said traversing device being driven for a changing movement in a changing direction having an orientation transverse to said spindle axes, a transfer device having a fixed position with respect to said spindle axes and a control device for controlling the driven changing movement of the traversing device in changing direction as well as for controlling the driven traversing movement of the traversing guide in traversing direction, the method comprising the steps of a) controlling the movement of said traversing device and said traversing guide for guiding the winding material from a package wound at a first one of said spindles via the transfer device to the second one of said spindles, b) catching the winding material by a catching device associated with the second spindle.

2. Method of claim 1, wherein said catching device is rotated with said second spindle and said catching device with the caught winding material driven by said second spindle moves the winding material versus a cutting device, said cutting device having a location fixed relative to said spindle axes and said cutting device cutting the winding material wherein the winding material is cut in dependence on the rotation of said second spindle or in dependence on the traversing movement of said traversing guide.

3. Method of claim 2, wherein in a projection into said spindle plane said transfer device is located between said spindle axes and behind or in front of bobbin tubes held by said spindles when seen in the direction of said spindle axes.

4. Method of claim 3, comprising the steps of controlling the driven movement of said traversing guide such that after having finished the winding process of said package on said first spindle said traversing guide is moved in traversing direction in front of or behind said package and the winding material is brought into contact with said transfer device, subsequently controlling the driven movement of said traversing guide for moving the traversing guide in opposite direction, wherein during the aforementioned steps the driven movement of said traversing device in changing direction is controlled such said at the end of the winding process of said package on said first spindle said traversing device is positioned in the neighborhood of said first spindle and at the start of a subsequent winding process said traversing device is positioned in the neighborhood of said second spindle.

5. Method of claim 2, wherein a relative movement between said cutting device and the winding material for cutting the winding material is solely caused by a rotational movement of said second spindle to a second angle of rotation.

6. Method of claim 1, wherein in a projection into said spindle plane said transfer device is located between said spindle axes and behind or in front of bobbin tubes held by said spindles when seen in the direction of said spindle axes.

7. Method of claim 6, comprising the steps of controlling the driven movement of said traversing guide such that after having finished the winding process of said package on said first spindle said traversing guide is moved in traversing direction in front of or behind said package and the winding material is brought into contact with said transfer device, subsequently controlling the driven movement of said traversing guide for moving the traversing guide in opposite direction, wherein during the aforementioned steps the driven movement of said traversing device in changing direction is controlled such said at the end of the winding process of said package on said first spindle said traversing device is positioned in the neighborhood of said first spindle and at the start of a subsequent winding process said traversing device is positioned in the neighborhood of said second spindle.

8. Method of claim 1, wherein said catching device is rotated with said second spindle and said catching device is brought into engagement with the winding material by rotating said catching device to a predetermined first angle of rotation and by moving the traverse guide into a catching position, in said catching position the winding material passing a catching region of said catching device.

9. Winding machine for winding a continuously fed winding material on bobbin tubes to wound packages comprising two driven spindles rotating around fixed and parallel spindle axes, said spindle axes defining a spindle plane, a traversing device holding a traversing guide, said traversing guide being guided and driven for a traversing movement along said traversing device in a traversing direction having an orientation parallel to said spindle axes, said traversing device being guided and driven for a changing movement in a changing direction having an orientation transverse to said spindle axes, a transfer device having a fixed position with respect to said spindle axes, a control device designed and configured for controlling both the changing movement of said traversing device in changing direction as well as for controlling the traversing movement of said traversing guide in traversing direction such that the winding material is guided along a path from a package wound on a first spindle of said two spindles via said transfer device with a bend of the winding material at said transfer device towards an empty bobbin tube on a second spindle of said two spindles or towards a catching device associated with said second spindle.

10. Winding machine of claim 9, wherein in a projection into said spindle plane said transfer device is located between said spindle axes and before or behind said bobbin tubes when seen in the direction of said spindle axes.

11. Winding machine of claim 9, wherein said control device controls the movement of said traversing device and said traversing guide such that said traversing guide is moved into a catching position, said catching position being located such that the path of the winding material between said transfer device and said traversing guide passes a catching region of said catching device.

12. Winding machine of claim 11, wherein said catching region rotates with said second spindle and an interaction between the winding material and said catching device is triggered by the rotation of said second spindle and of said catching region to a predetermined angle of rotation.

13. Winding machine of claim 9, wherein when seen in a projection into said spindle plane the winding material is guided by said transfer device along a V-shaped path, said transfer device being located at the intersection point of ends of the legs of the V.

14. Winding machine according to claim 9, wherein said transfer device comprises two redirecting regions for the winding material, said redirecting regions being positioned offset from each other when seen in the direction of the spindle axes and said redirecting regions being designed and configured for redirecting the winding material with curvatures in opposite directions.

15. Winding machine according to claim 9 comprising a cutting device, said cutting device having a fixed location with respect to said spindle axes and said cutting device automatically cutting the winding material.

16. Winding machine of claim 15, wherein said cutting device and said transfer device are built by one single assembly unit.

17. Winding machine of claim 15, wherein said transfer device is built with two V-shaped rods.

18. Winding machine according to claim 17, wherein said cutting device is located in the linked end regions of said rods.

19. Winding machine according to claim 15 wherein a relative movement between said cutting device and the winding material responsible for cutting the winding material is caused by a rotation of said spindle with said catching device.

20. Winding machine of claim 9, wherein said transfer device is built with two V-shaped rods.

* * * * *